US010580596B2

(12) United States Patent
Chiu

(10) Patent No.: US 10,580,596 B2
(45) Date of Patent: Mar. 3, 2020

(54) KEY STRUCTURE

(71) Applicant: ASUSTeK COMPUTER INC., Taipei (TW)

(72) Inventor: Chien-Hsing Chiu, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 15/848,508

(22) Filed: Dec. 20, 2017

(65) Prior Publication Data

US 2018/0182575 A1 Jun. 28, 2018

(30) Foreign Application Priority Data

Dec. 27, 2016 (TW) ..... 105143452 A

(51) Int. Cl.

| | |
|---|---|
| ***H01H 13/14*** | (2006.01) |
| ***H01H 13/10*** | (2006.01) |
| ***H01H 13/85*** | (2006.01) |
| *H01H 13/704* | (2006.01) |

(52) U.S. Cl.

CPC ..... *H01H 13/14* (2013.01); *H01H 13/10* (2013.01); *H01H 13/85* (2013.01); *H01H 13/704* (2013.01); *H01H 2203/056* (2013.01); *H01H 2205/004* (2013.01); *H01H 2215/006* (2013.01)

(58) Field of Classification Search

CPC .... H01H 13/702; H01H 13/14; H01H 13/705; H01H 13/83; H01H 3/125; H01H 13/70; H01H 13/7065; H01H 2215/004; H01H 13/85; H01H 13/10; H01H 2215/006; H01H 2203/056; H01H 13/704; H01H 2205/004; H01H 2221/002

USPC ..... 200/5 A, 341, 512

See application file for complete search history.

(56) References Cited

U.S. PATENT DOCUMENTS

| | | | | |
|---|---|---|---|---|
| 6,064,020 | A | 5/2000 | Yamada et al. | |
| 2007/0278083 | A1* | 12/2007 | Iso | H01H 13/702 200/512 |
| 2009/0288936 | A1 | 11/2009 | Cheng et al. | |

FOREIGN PATENT DOCUMENTS

| | | | |
|---|---|---|---|
| CN | 1493960 | A | 5/2004 |
| CN | 2824263 | Y | 10/2006 |
| CN | 101540240 | A | 9/2009 |
| CN | 101587789 | A | 11/2009 |
| CN | 102005324 | A | 4/2011 |
| CN | 201812705 | U | 4/2011 |
| CN | 201845684 | U | 5/2011 |
| CN | 202275757 | U | 6/2012 |
| CN | 202404524 | U | 8/2012 |
| EP | 0502452 | A1 | 9/1992 |

(Continued)

OTHER PUBLICATIONS

Office Action issued in corresponding China patent application dated Jan. 14, 2019.

*Primary Examiner* — Ahmed M Saeed

(74) *Attorney, Agent, or Firm* — McClure, Qualey & Rodack, LLP

(57) ABSTRACT

A key structure comprises a baseplate, a film circuit board, an elastic body and a keycap. The film circuit board includes a deformation region and a support region. The support region is disposed on the baseplate, and a deformation space is formed between the deformation region and the baseplate. The elastic body is disposed on the film circuit board. The keycap is disposed on the elastic body.

7 Claims, 12 Drawing Sheets

(56) References Cited

FOREIGN PATENT DOCUMENTS

| | | | |
|---|---|---|---|
| GB | 2133625 | A | 7/1984 |
| JP | 11339587 | A | 12/1999 |

* cited by examiner

KEY STRUCTURE

CROSS-REFERENCE TO RELATED APPLICATION

This application claims the priority benefit of Taiwan application serial No. 105143452, filed on Dec. 27, 2016. The entirety of the above-mentioned patent application is hereby incorporated by reference herein and made a part of specification.

BACKGROUND OF THE INVENTION

Field of the Invention

The disclosure relates to a keyboard device and, more particularly, to a key structure of a keyboard device.

Description of the Related Art

The keyboard device is a necessary peripheral device used for data inputting. The performance of the key structure is various according to different key structures of the keyboard device. The performance of the key structure is important for users who need long time inputting. However, the key structures usually have a problem of missing words in usage.

BRIEF SUMMARY OF THE INVENTION

According to an aspect of the disclosure, a key structure is provided. The key structure comprises: a film circuit board, including a deformation region and a support region, the support region is disposed on the baseplate, and a deformation space is formed between the deformation region and the baseplate; an elastic body, disposed on a side of the film circuit board away from the baseplate; and a keycap, disposed on the elastic body, wherein when the keycap is pressed, the keycap presses the elastic body, and the elastic body deforms to trigger the film circuit board, the deformation region of the film circuit board deforms towards the baseplate.

According to another aspect of the disclosure, a key structure is provided. The key structure comprises: a baseplate; a film circuit board, including a deformation region and a support region, the support region is disposed on the baseplate, and a deformation space is formed between the deformation region and the baseplate; an elastic body, disposed on a side of the film circuit board away from the baseplate; a keycap, disposed on the elastic body; and a scissors support structure, disposed between the keycap and the baseplate, wherein when the keycap is pressed, the keycap presses the elastic body, and the elastic body deforms to trigger the film circuit board, the deformation region of the film circuit board deforms towards the baseplate.

DETAILED DESCRIPTION OF THE EMBODIMENTS

Figure 1:
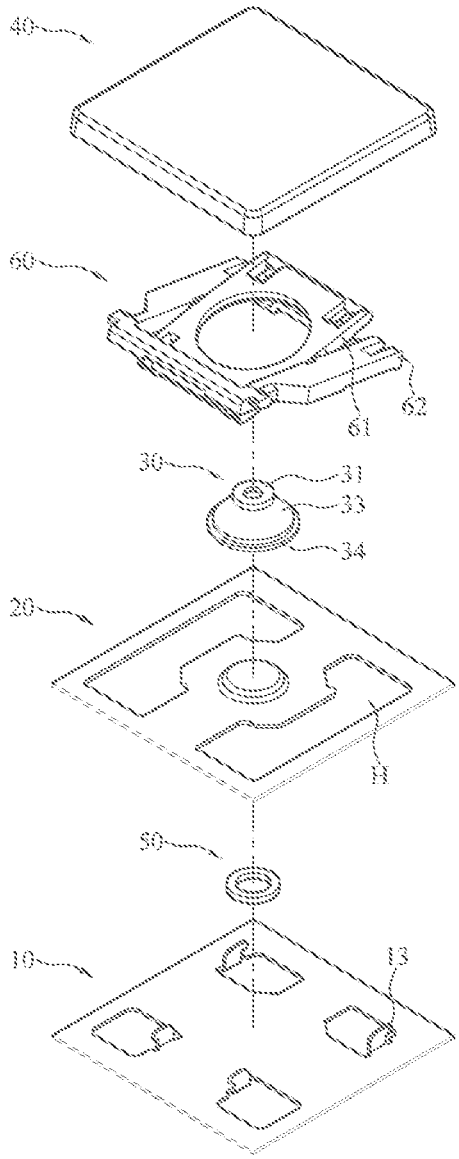
FIG. 1 is a schematic diagram showing a dimensional structure of a key structure in an embodiment.
Figure 2:
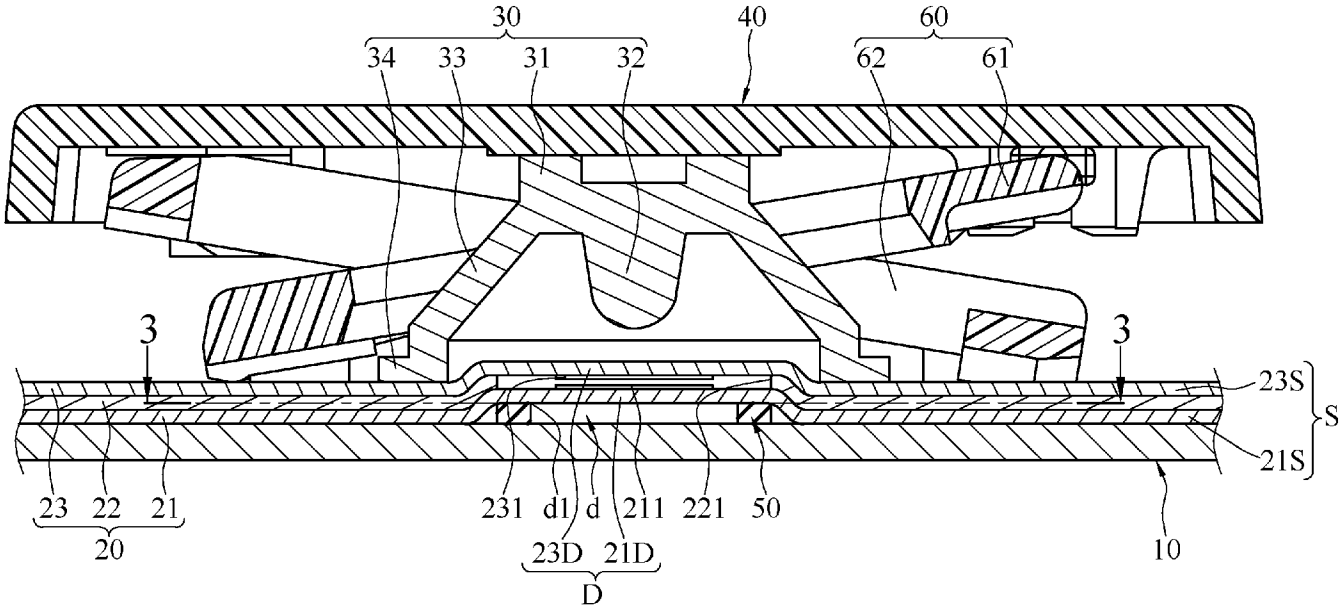
FIG. 2 is a cross-sectional view of a key structure in an embodiment.

Please refer to FIG. 1 and FIG. 2. FIG. 1 is a schematic diagram showing a dimensional structure of a key structure in an embodiment. FIG. 2 is a cross-sectional view of a key structure in an embodiment.

The key structure of the embodiment includes a baseplate 10, a film circuit board 20, an elastic body 30, and a keycap 40. The film circuit board 20 is a flexible circuit board. The film circuit board 20 includes a support region S and a deformation region D connected with each other. The support region S is disposed on the baseplate 10. A deformation space d is formed between the deformation region D and the baseplate 10. The elastic body 30 is disposed on the film circuit board 20. The keycap 40 covers on the elastic body 30. When the elastic body 30 is pressed under a press on the keycap 40, the elastic body 30 presses against the film circuit board 20 in the deformation region D, and the film circuit board 20 is pressed and deforms towards the deformation space d.

Figure 3:
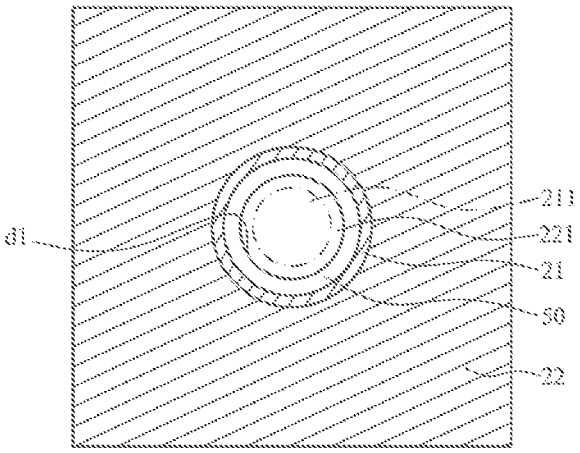
FIG. 3 is another cross-sectional view of the key structure in FIG. 2.

Please refer to FIG. 2 and FIG. 3, the film circuit board 20 in the embodiment includes a lower film layer 21, a spacer layer 22, and an upper film layer 23 stacked in sequence. The lower film layer 21 includes a first support portion 21S and a first deformation portion 21D. The upper film layer 23 includes a second support portion 23S and a second deformation portion 23D. The support region S of the film circuit board 20 includes a first support portion 21S and a second support portion 23S. The deformation region D of the film circuit board 20 includes a first deformation portion 21D and a second deformation portion 23D.

The first support portion 21S is configured on the baseplate 10. The first deformation portion 21D is closer to the elastic body 30 in the direction vertical to the baseplate 10 compared with the first support portion 21S. As a result, a deformation space d is formed between the film circuit board 20 and the baseplate 10. The first deformation portion 21D is configured on a lower conductive portion 211. In an embodiment, the lower conductive portion 211 is a conductive silver paste circuit. The first deformation portion 21D adjacent to the deformation space d has an edge d1. As shown in FIG. 3, in the direction vertical to the baseplate 10, the lower conductive portion 211 is located within the contour range of the edge d1, and. Thus, the lower conductive portion 211 can be extended and deformed into the deformation space d via the edge d1.

The spacer layer 22 includes a penetrating portion 221. The position of the penetrating portion 221 of the spacer layer 22 corresponds to the first deformation portion 21D of the lower film layer 21. The spacer layer 22 is made of an insulating material.

The second support portion 23S is configured on the spacer layer 22. The position of the second deformation portion 23D corresponds to the position of the penetrating portion 221. An upper conductive portion 231 is configured on the second deformation portion 23D. The upper conductive portion 231 faces to the lower conductive portion 211. The upper conductive portion 231 is a conductive silver paste circuit. The upper conductive portion 231 of the upper film layer 23 and the lower conductive portion 211 of the lower film layer 21 extend into the penetrating portion 221 of the spacer layer 22.

The elastic body 30 includes a top portion 31, a contact portion 32, a sloping wall 33, and a base 34. The contact portion 32 is a cylinder structure and is disposed at a central position of a side of the top portion 31. The sloping wall 33 is disposed at a peripheral edge of the top portion 31 and extends toward the free end of the contact portion 32. The length of the sloping wall 33 in the direction vertical to the top portion 31 is larger than the length of the contact portion 32 in the direction vertical to the top portion 31. The base 34 is disposed at the free end of the sloping wall 33. The base 34 of the elastic body 30 is disposed on the upper film layer 23. The position of the contact portion 32 corresponds to the position of the second deformation portion 23D of the upper film layer 23. In an embodiment, the elastic body 30 is a rubber dome made of a rubber material.

A functional or a command symbols is configured on one side of the keycap 40 for users to recognize the function or the instruction of the keycap 40. A groove is configured at the other side of the keycap 40. The bottom of the groove is disposed on the top portion 31 of the elastic body 30. When the keycap 40 is pressed, the elastic body 30 is compressed and deformed, and the film circuit board 20 is triggered. After the keycap 40 is moved to the end of the route, the elastic body 30 resets, and the keycap 40 moves back to the original position.

Figure 4:
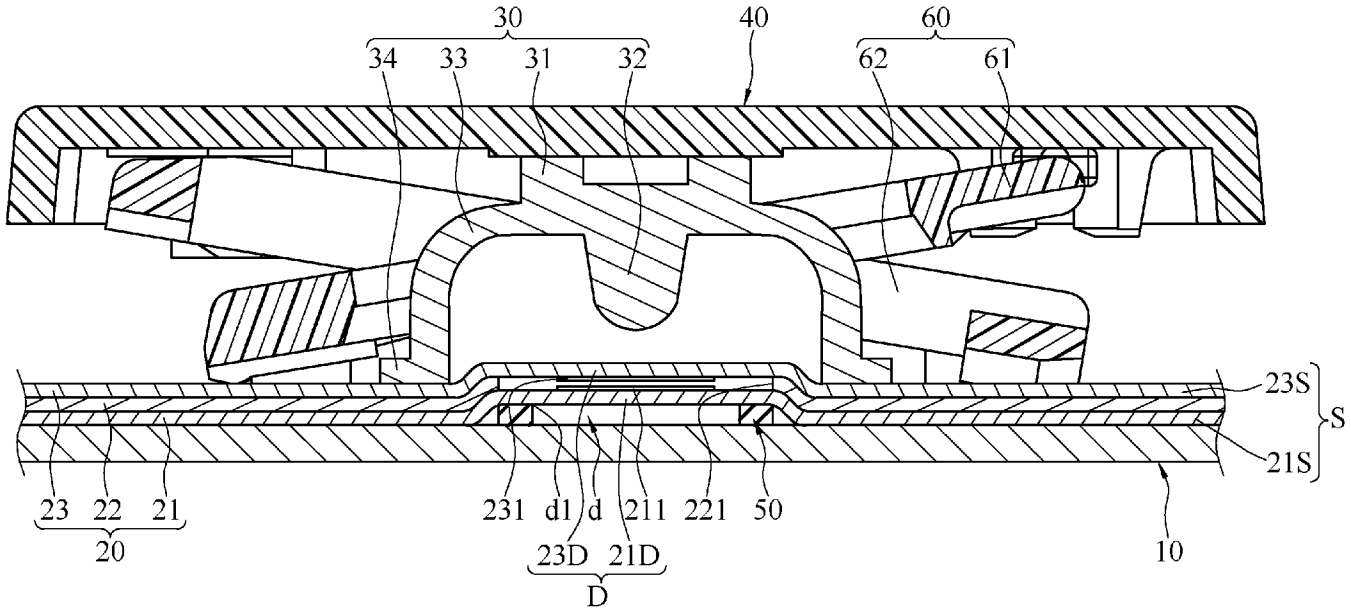
FIG. 4 to FIG. 6 are schematic diagrams showing operations of the key structure in FIG. 2.
Figure 5:
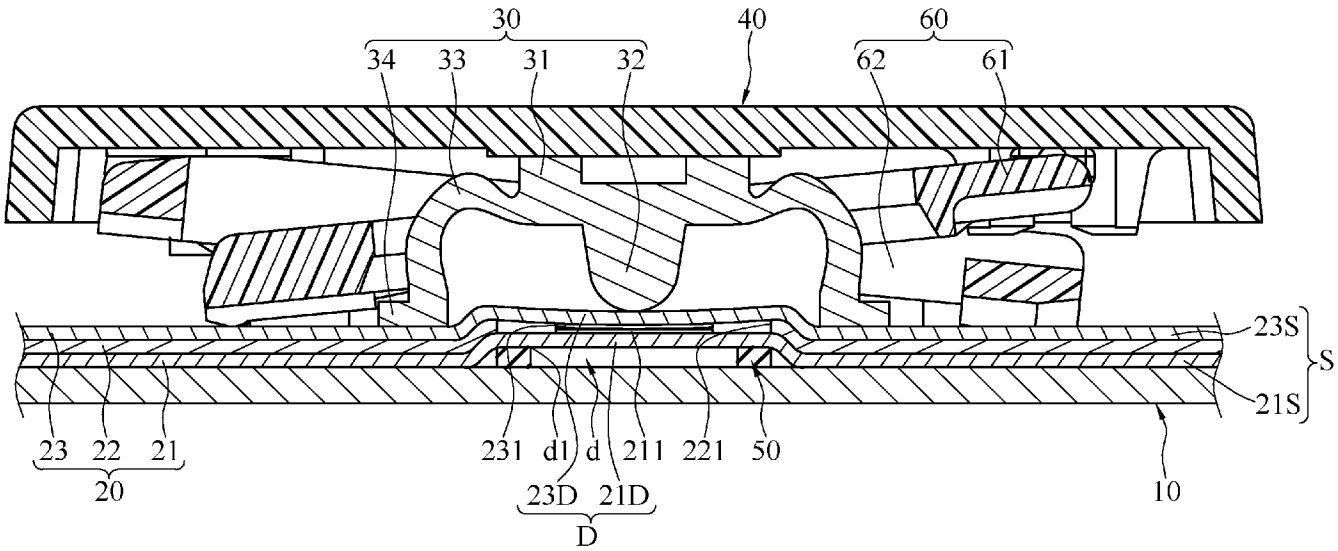
Figure 6:
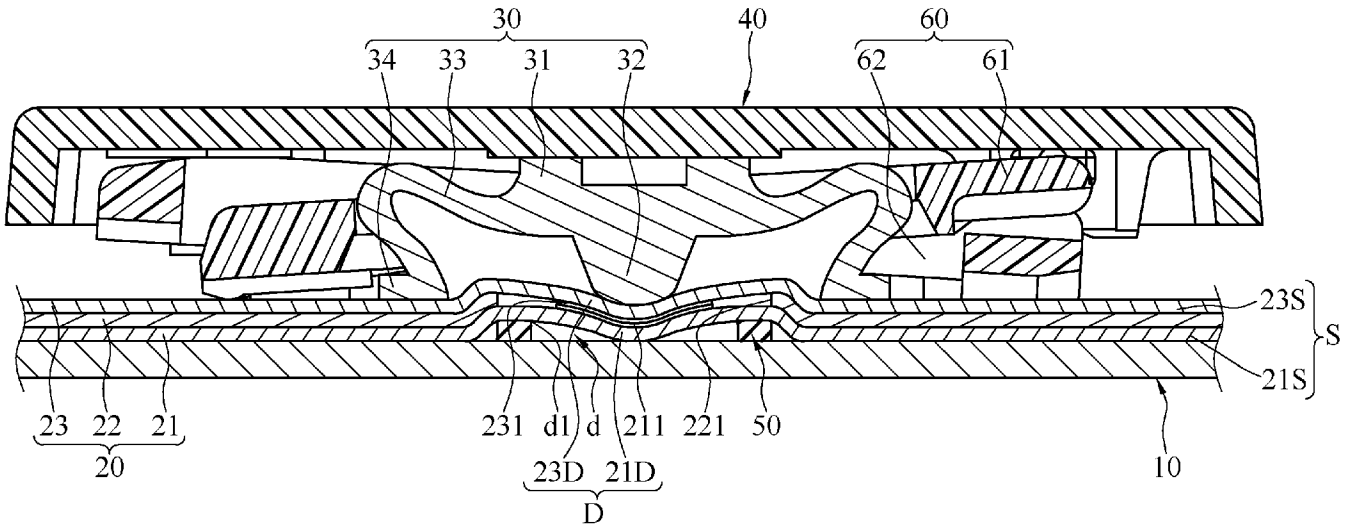
Figure 12:
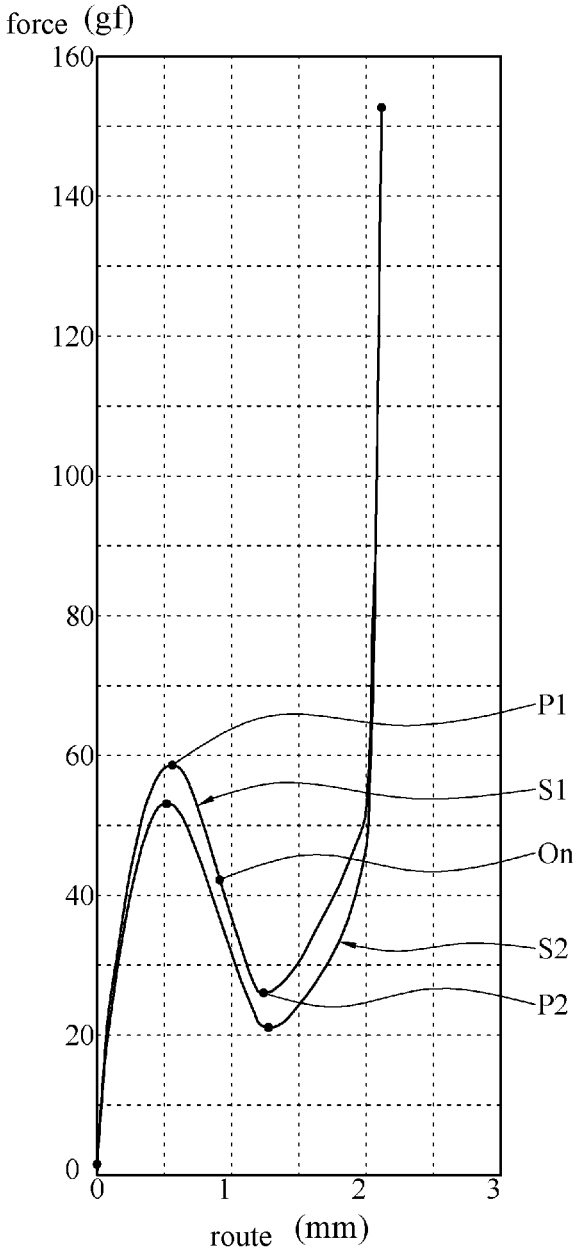
FIG. 12 is a graph shows a force-route curve of the elastic body in an embodiment.

Please refer to FIG. 4 to FIG. 6 and FIG. 12. FIG. 4 to FIG. 6 are schematic diagrams showing the process of pressing the keycap 40 to trigger the film circuit board 20. FIG. 12 is a graph shows a force-route curve of the elastic body in an embodiment. The abscissa of FIG. 12 shows the distance of the route that the keycap 40 presses the elastic body 30, and the ordinate is the force applied from the keycap 40 to the elastic body 30. In FIG. 12, a first curve S1 is for the keycap 40 moving downward to the end of the route, and a second curve S2 is for the keycap 40 moving from the end of the route to the original state.

When the keycap 40 is continuously pressed down, the pressure on the elastic body 30 gradually increases. As shown in FIG. 12, the first curve S1 extends upwardly from the coordinate origin continuously.

As shown in FIG. 4, when the force applied to the elastic body 30 reaches the maximum deformation resistance of the sloping wall 33, the sloping wall 33 of the elastic body 30 starts to deform. The force applied to the elastic body 30 is absorbed via the deformation of the sloping wall 33 of the elastic body 3. The force applied to the elastic body 30 starts to decrease. The top portion 31 of the elastic body 30 moves downwardly due to the deformation of the sloping wall 33 of the elastic body 30. The force point that the sloping wall 33 of the elastic body 30 bears the maximum deformation resistance is defined as the collapse point P1. The force condition after the keycap 40 starts to deform is shown as the first curve S1 extended downward continuously from the collapse point P1 in FIG. 12.

When the top portion 31 moves downwardly due to the deformation of the sloping wall 33, the contact portion 32 of the elastic body 30 simultaneously moves downwardly and contacts the second deformation portion 23D of the film circuit board 20. The film circuit board 20 is pressed by the contact portion 32 and starts to deform from the second deformation portion 23D of the upper film layer 23. The second deformation portion 23D of the upper film layer 23 deforms and passes through the penetrating portion 221 of the spacer layer 22. When the elastic body 30 is continuously pressed and deformed, the second deformed portion 23D of the upper film layer 23 is continuously deformed, and the upper conductive portion 231 contacts the lower conductive portion 211 of the lower film layer 21. When the upper conductive portion 231 contacts the lower conductive portion 211, the film circuit board 20 is conducted to transmit a signal corresponding to the key structure as shown in FIG. 5. The force point at which the film circuit board 20 is conducted when the elastic body 30 is pressed is defined as a conductive point On.

In the embodiment, since the deformation space d is configured between the film circuit board 20 and the baseplate 10, the first deformed portion 21D of the lower film layer 21 continuously deforms towards the deformation space d after the film circuit board 20 is conducted.

Since the film circuit board 20 can be continuously deformed in the deformation space d, the film circuit board 20 does not reach the end of the displacement route when the film circuit board 20 is conducted. In an embodiment, the keycap 40 can be pressed continuously until the keycap 40 reaches the end of the displacement route. In an embodiment, the keycap 40 would not reach the end of the displacement route until the film circuit board 20 has largest deformation when the elastic body 30 continuously presses the film circuit board 20. In this embodiment, the keycap 40 reaches the end of the displacement route when the film circuit board 20 is deformed to contact the contact the baseplate 10 as shown in FIG. 6. When the keycap 40 reaches the end of the displacement route, the elastic body 30 and the film circuit board 20 would not be further deformed. The force condition during the elastic body 30 begins to deform to the end of the displacement route of the keycap 40 is shown as the section of the first curve S1 from the collapse point P1 to the turning point in the vertical axis direction in FIG. 12.

When the keycap 40 is continuously pressed after the keycap 40 reaches the end of the displacement route, since the elastic body 30 cannot have further deformation, the force on the elastic body 30 is increased. The force point that the force of the elastic body 30 is turned is defined as the contact point P2. The force condition after the force of the elastic body 30 is turned is shown as the section of the first curve S1 from the contact point P2 and extending upward in FIG. 12. The force of the elastic body 30 is restored to the original state according to the second curve S2 until the force applied to the keycap 40 is released.

Users always have a habit to press the keycap 40 until the keycap 40 cannot move anymore in typing. In the embodiment, the conductive point On of the film circuit board 20 of the key structure is before the contact point P2 in the press process. Thus, users do not need to change the typing habit to trigger the film circuit board 20 while words are not easily missed.

In an embodiment, a spacer 50 is configured between the first deformation portion 21D of the lower film layer 21 and the baseplate 10 to form a deformation space d. In an embodiment, the spacer 50 is circular and has a hollow portion. The spacer 50 is configured between the first deformation portion 21D of the lower film layer 21 of the film circuit board 20 and the baseplate 10. Thus, a distance is formed between the deformation portion 21D of the lower film layer 21 and the hollow portion to form the deformation space d. The edge d1 is defined by the contour range of the inner peripheral surface of the spacer 50.

As a result, the first deformation portion 21D of the lower film layer 21 of the film circuit board 20 is pushed up and approaches to the contact portion 32. Thus, the distance of the route that the contact portion 32 triggers the film circuit board 20 is shortened, which is time-saving. With the deformation space d, a further deformation is allowed after the trigger of the film circuit board 20. The trigger time is before that of the end of the displacement route of the keycap 40 (or before that of the maximum deformation of the film circuit board 20). As a result, the probability of missing words is reduced.

Figure 7:
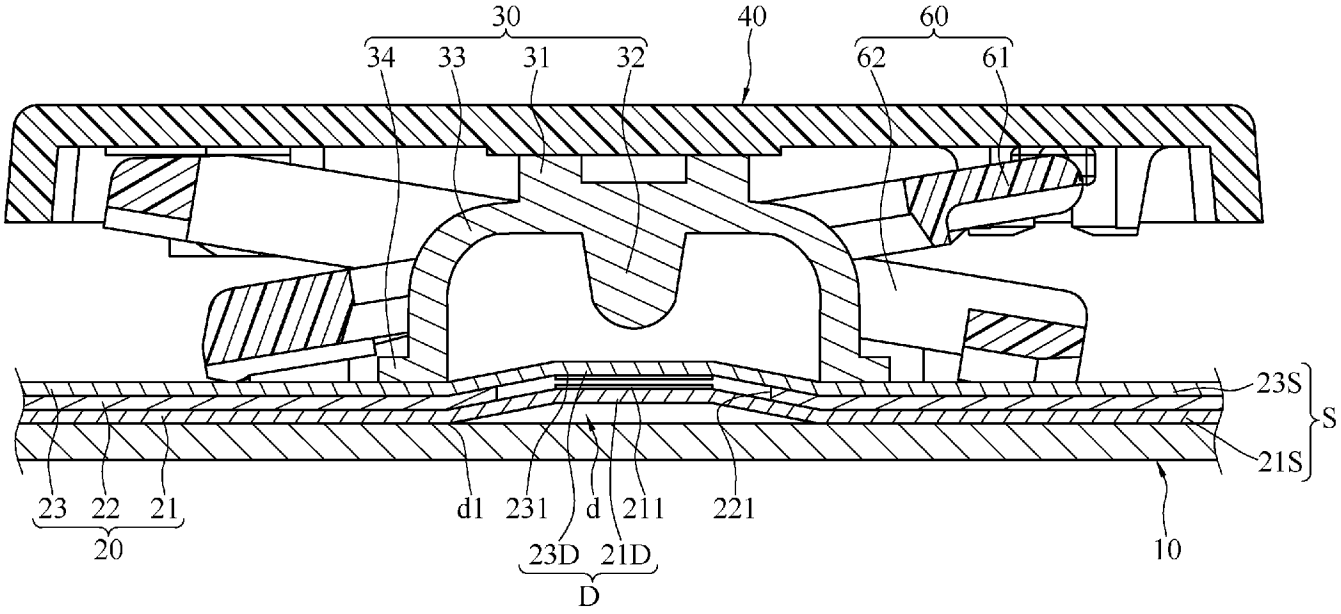
FIG. 7 is a cross-sectional view of a key structure in an embodiment.

FIG. 7 is a schematic diagram showing the film circuit board 20 of the key structure in an embodiment. In comparison with the first support portion 21S, the first deformation portion 21D of the lower film layer 21 of the film circuit board 20 is closer to the elastic body 30 in the direction of the vertical to the baseplate 10. In comparison with the second support portion 23S, the deformation portion 23D of the second film layer 23 is closer to the elastic body in the direction of the vertical to the baseplate 10. Thus, in comparison with the support region S, the deformation region D of the film circuit board 20 is closer to the elastic body 30 in a direction vertical to the baseplate 10. Thus, a raised structure is formed. The deformation space d is formed between the raised portion of the film circuit board 20 and the baseplate 10.

Figure 8:
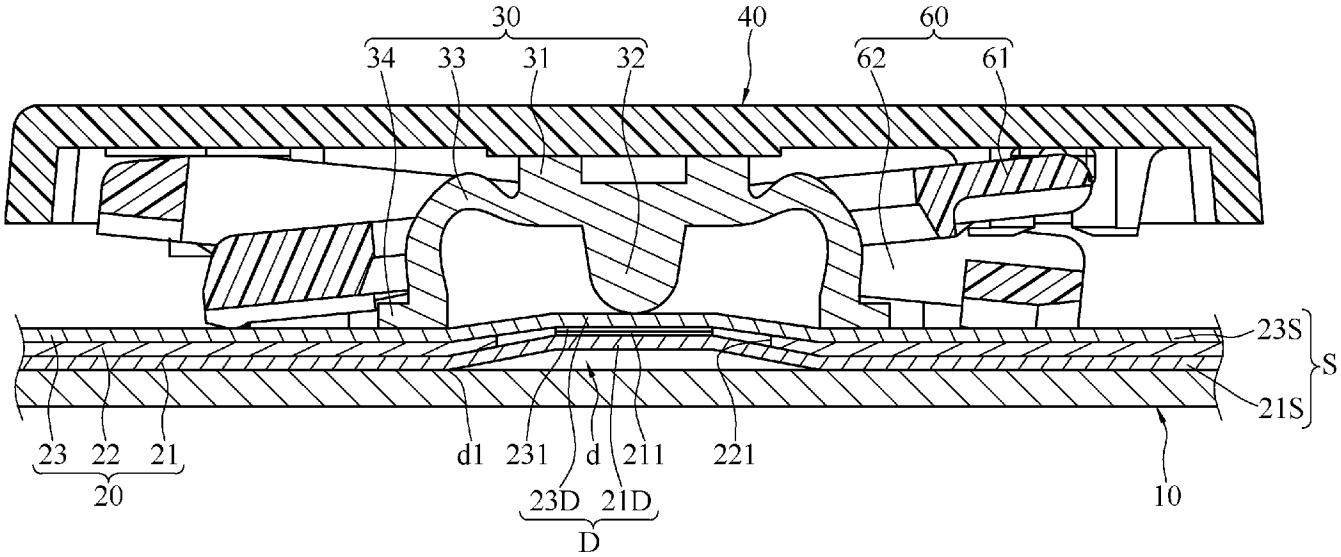
FIG. 8 to FIG. 10 are schematic diagrams showing operations of the key structure in FIG. 7.

Please refer again to FIG. 8 to FIG. 10, FIG. 8 to FIG. 10 are schematic diagrams showing operations of the key structure. When the keycap 40 is pressed, the sloping wall 33 of the elastic body 30 is deformed. When the film circuit board 20 is pressed by the contact portion 32 of the elastic body 30 and the elastic body 30 is continuously deformed, the upper conductive portion 231 of the upper film layer 23 of the film circuit board 20 contacts the lower conductive portion 211 of the lower film layer 21, and the signal corresponding to the key structure is transmitted as shown in FIG. 8.

Figure 9:
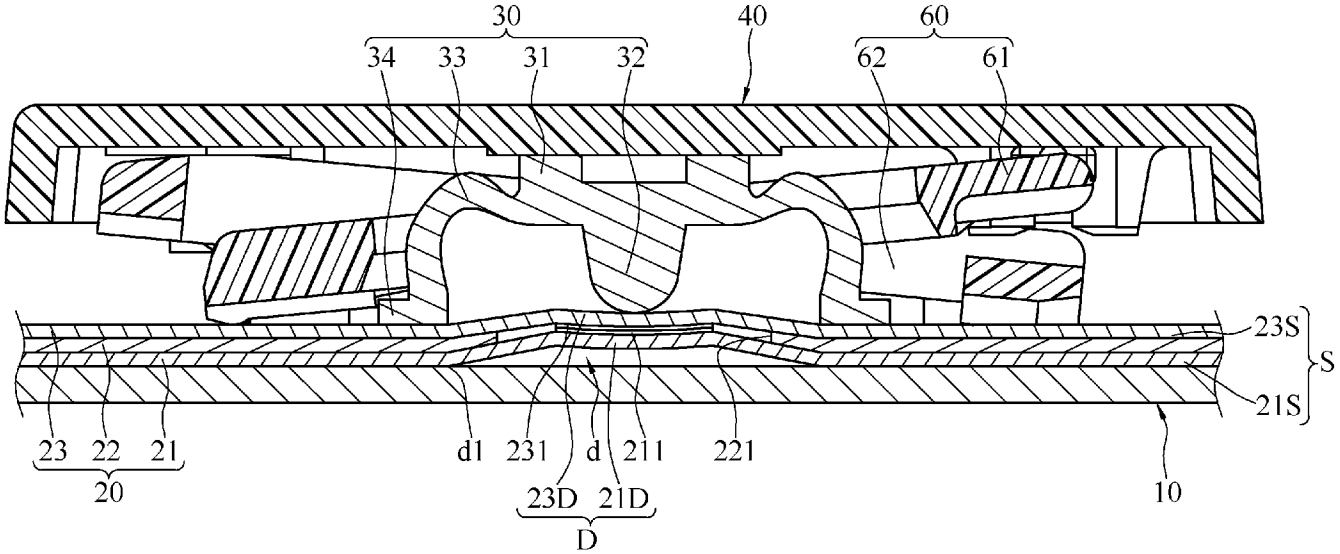
Figure 10:
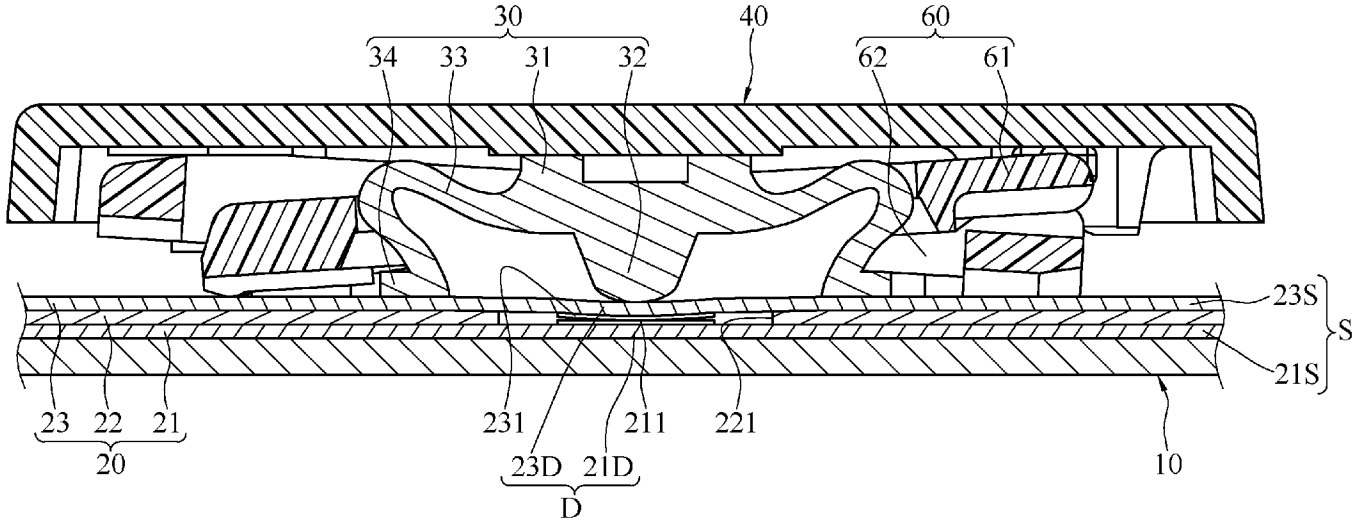

After the film circuit board 20 is triggered, if the keycap 40 is continuously pressed, the contact portion 32 of the elastic body 30 continuously moves down. Then, the film circuit board 20 is deformed into the deformation space d after the film circuit board 20 is triggered and conducted as shown in FIG. 9. The film circuit board 20 stops deforming when the film circuit board 20 is deformed to contact the baseplate 10. The position where the film circuit board 20 touches the baseplate 10 is the deformation termination position of the film circuit board 20, and the position is also the end of displacement route of the keycap 40, as shown in FIG. 10. Thus, the trigger time of the film circuit board 20 is before the time of the end of the displacement route of the keycap 40 (or before the time of the maximum deformation of the film circuit board 20).

Figure 11:
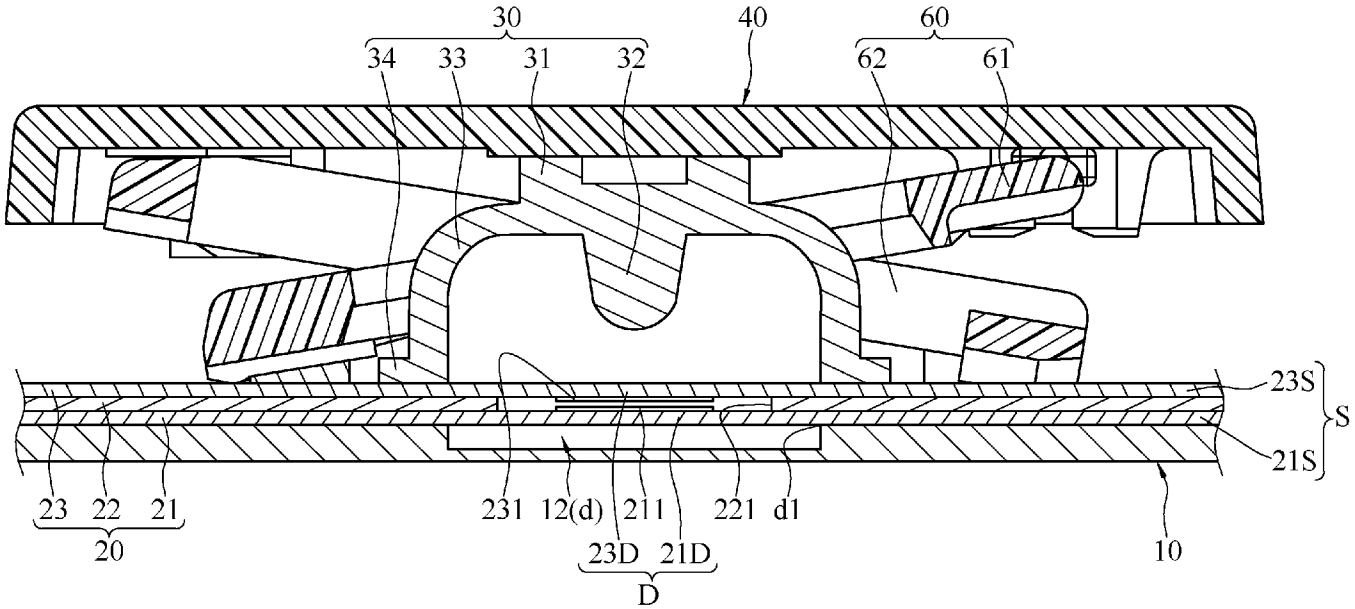
FIG. 11 is a cross-sectional view of a key structure in an embodiment.

Please refer again to FIG. 11. In the embodiment, the film circuit board 20 has a planar shape. In this embodiment, the baseplate 10 includes a recess 12 in the deformation region D of the film circuit board 20. The recess 12 extends from the baseplate 10 in a direction of away from the elastic body 30. The recessed portion of the recess 12 is the deformation space d. The deformation space d allows the film circuit board 20 to continue to be deformed after the film circuit board 20 is conducted. Consequently, the trigger time is before the time of the end of the displacement route of the keycap 40 (or before the time of the maximum deformation of the film circuit board 20). The probability of the missing word can be reduced in usage.

The collapse point P1 of the elastic body 30 in embodiments is difference depending on the material of the elastic body 30, the thickness of the sloping wall 33 of the elastic body 30, or the shape of the elastic body 30. The value of the collapse point P1 of the elastic body 30 is not limited in embodiments. With the configuration of a deformation space d between the deformation region D of the film circuit board 20 and the baseplate 10, the film circuit board 20 is allowed to continue deforming after the film circuit board 20 is triggered and conducted. As a result, the film circuit board 20 is triggered before the end of the displacement route of the keycap 40. The probability of the missing word is reduced.

In an embodiment, to ensure the pressure to the keycap 40 uniform, a scissor support structure 60 is configured between the keycap 40 and the baseplate 10 to support the keycap 40. In order to position and restrict the displacement of the scissor support structure 60, four limiting portions 13 are configured on the baseplate 10. In an embodiment, the limiting portion 13 is an inverted L-shaped protrusion. In an embodiment, the limiting portion 13 is integrally formed by stamping the baseplate 10. The film circuit board 20 includes two through holes H. Each of the through-holes H is a long shape opening. The film circuit board 20 is configured on the baseplate 10. The limiting portions 13 passes through the through holes H.

The scissor support structure 60 includes a first support element 61 and a second support element 62. The first support element 61 and the second support element 62 are rectangular frame structures. The first support element 61 is crossed connected with the second support element 62 at a position between ends. One end of the first support element 61 is pivotally connected to two of the limiting portions 13 of the baseplate 10. The other end of the first support element 61 is linearly movably in the recess. In the embodiment, one end of the second support element 62 is pivotally connected to the other two limiting portions 13 of the baseplate 10, and the other end is of the second support element 62 linearly movably in the recess of the keycap 40. The elastic body 30 is located at the center portion of the first support element 61 and the second support element 62. In this way, when the keycap 40 is pressed, the stress on the keycap 40 is equally distributed at the first support element 61 and the second support element 62.

Although the present invention has been described in considerable detail with reference to certain preferred embodiments thereof, the disclosure is not for limiting the scope. Persons having ordinary skill in the art may make various modifications and changes without departing from the scope. Therefore, the scope of the appended claims should not be limited to the description of the preferred embodiments described above.

What is claimed is:

1. A key structure, comprising:

a baseplate;

a film circuit board, including a deformation region, a support region, a lower film layer, a spacer layer, and an upper film layer, the support region is disposed on the baseplate, the spacer layer is disposed between the upper film layer and the lower film layer to form the deformation region, the lower film layer is disposed on one side of the spacer layer adjacent to the baseplate, and the upper film layer is disposed on the other side of the spacer layer away from the baseplate;

an elastic body, disposed on a side of the film circuit board away from the baseplate; and a keycap, disposed on the elastic body, wherein when the keycap is pressed, the keycap presses the elastic body, and the elastic body deforms to trigger the film circuit board, the deformation region of the film circuit board deforms towards the baseplate;

wherein the lower film layer includes a first support portion and a first deformation portion, and the upper film layer includes a second deformation portion and a second support portion, the first support portion is configured on the baseplate, and the second support portion is configured on the spacer layer, the first deformation portion is closer to the elastic body in the direction of the vertical to the baseplate in comparison with the first support portion and the second deformation portion is closer to the elastic body in the direction of the vertical to the baseplate in comparison with the second support portion to form a raised structure, and a deformation space is formed between the baseplate and the raised portion at the first deformation portion.

2. The key structure according to claim 1, wherein a spacer is disposed between the baseplate and the deformation region of the film circuit board, the spacer includes a hollow portion, and the deformation space is formed between the film circuit board and the hollow portion.

3. The key structure according to the claim 1, wherein the second deformation portion and the second support portion are configured on the other side of the spacer layer opposite to the side of the lower film layer.

4. The key structure according to the claim 1, wherein the lower film layer includes a lower conductive portion, the spacer layer includes a penetrating portion, the upper film layer includes an upper conductive portion, and the upper conductive portion faces to the lower conductive portion.

5. The key structure according to the claim 4, wherein the upper conductive portion and the lower conductive portion are conductive silver paste circuits.

6. The key structure according to the claim 1, wherein the elastic body further includes a top portion, a contact portion, a sloping wall, and a base, the contact portion is configured on a side of the top portion, the sloping wall is configured at a peripheral edge of the top portion, and the base is configured at an end of the sloping wall away from the top portion.

7. A key structure, comprising:

a baseplate;

a film circuit board, including a deformation region, a support region, a lower film layer, a spacer layer, and an upper film layer, the support region is disposed on the baseplate, the spacer layer is disposed between the upper film layer and the lower film layer to form the deformation region, the lower film layer is disposed on one side of the spacer layer adjacent to the baseplate, and the upper film layer is disposed on the other side of the spacer layer away from the baseplate;

an elastic body, disposed on a side of the film circuit board away from the baseplate;

a keycap, disposed on the elastic body; and a scissors support structure, disposed between the keycap and the baseplate, wherein when the keycap is pressed, the keycap presses the elastic body, and the elastic body deforms to trigger the film circuit board, and the deformation region of the film circuit board deforms towards the baseplate;

wherein the lower film layer includes a first support portion and a first deformation portion, and the upper film layer includes a second deformation portion and a second support portion, the first support portion is configured on the baseplate, and the second support portion is configured on the spacer layer, the first deformation portion is closer to the elastic body in the direction of the vertical to the baseplate in comparison with the first support portion and the second deformation portion is closer to the elastic body in the direction of the vertical to the baseplate in comparison with the second support portion to form a raised structure, and a deformation space is formed between the baseplate and the raised portion at the first deformation portion.

* * * * *